US006176768B1

(12) United States Patent
Juang

(10) Patent No.: US 6,176,768 B1
(45) Date of Patent: Jan. 23, 2001

(54) TWO SURFACE PLANER

(76) Inventor: Boy Yann Juang, No.78, Yuang Feng Road, Taiping,Taichung (TW)

( * ) Notice: Under 35 U.S.C. 154(b), the term of this patent shall be extended for 0 days.

(21) Appl. No.: 09/247,570

(22) Filed: Feb. 10, 1999

(51) Int. Cl.[7] ..... B27C 1/00
(52) U.S. Cl. ..... 451/302; 144/114.1; 144/117.1
(58) Field of Search ..... 451/302; 144/114.1, 144/117.1, 129, 130

(56) References Cited

U.S. PATENT DOCUMENTS

| | | | | |
|---|---|---|---|---|
| 1,240,769 | * | 9/1917 | Osteman | 144/114.1 |
| 2,102,186 | * | 12/1937 | Nicholson et al. | 144/114.1 X |
| 3,171,454 | * | 3/1965 | Boice | 144/130 X |
| 4,842,029 | * | 6/1989 | De Abreu | 144/117.1 |
| 5,345,983 | * | 9/1994 | De Abreu | 144/114.1 X |

* cited by examiner

*Primary Examiner*—David A. Scherbel
*Assistant Examiner*—Anthony Ojini
(74) *Attorney, Agent, or Firm*—Dougherty & Troxell

(57) ABSTRACT

A two surface planer includes a lower base with a rear stationary table and a front sloped member sloping up to an intermediate portion, an adjusting base with an upper horizontal surface, and an activating rod pivot-ally connected with the adjusting base and the sloped member to let the adjusting base lifted up and lowered down on the sloped member. A lower cutter head is further provided in the intermediate portion of the lower base, having an lateral upper opening for a cutter of a lower cutter shaft rotatably contained in the lower cutter head, with the cutter protruding up out of the opening for a preset distance. When the adjusting base is lowered below the cutter by operation of the activating rod rotated by a hand wheel, the cutter can plane wood workpiece, and then two surfaces (the upper and the lower) of wood can be planed synchronously.

5 Claims, 3 Drawing Sheets

TWO SURFACE PLANER

BACKGROUND OF THE INVENTION

This invention relates to a two surface planer, particularly to one possible to plane a single surface and two (an upper and a lower) surfaces of wood at the same time.

A planer is a main wood machine for planing a rough surface of wood and smoothing it into a flat smooth surface. The applicant of this invention acquired a Taiwan patent titled "Planer" of No. 240532 dated Feb. 11, 1994, and a Taiwan patent titled "Roller replacing device for planers" of No. 298876 dated Feb. 21, 1996. The planer of the patent of No. 240532 has been widely accepted in its use. However, it only planes single surface of wood at one time, so wood has to be turned over to let the other surface planed.

SUMMARY OF THE INVENTION

Though a small planer for cutting a single surface of wood is simple and light in weight, a two surface planer with a small weight has been growing in demand gradually so as to speed up planing wood to save time.

The main purpose of the invention is to offer a two surface planer provided with a lower base, an adjusting base possible to be raised up and lowered down, and a lower cutter head for cutting a lower surface of wood.

A second purpose of the invention is to offer a two surface planer provided with an upper cutter of an upper cutter head and a lower cutter of a lower cutter head operating at the same time for planing an upper surface and a lower surface of wood synchronously.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
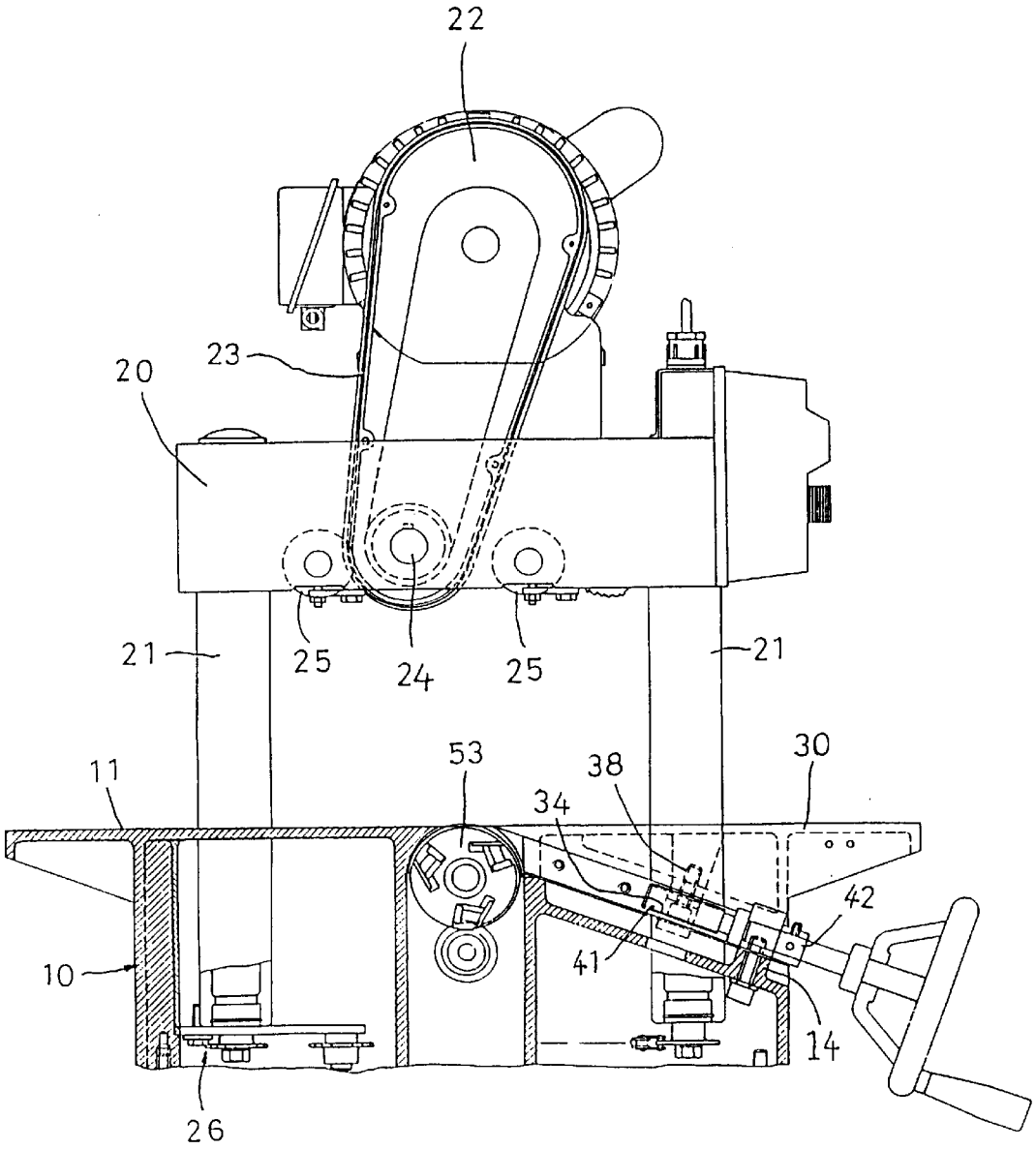
FIG. 1 is a cross-sectional view of a two surface planer in the present invention.
Figure 2:
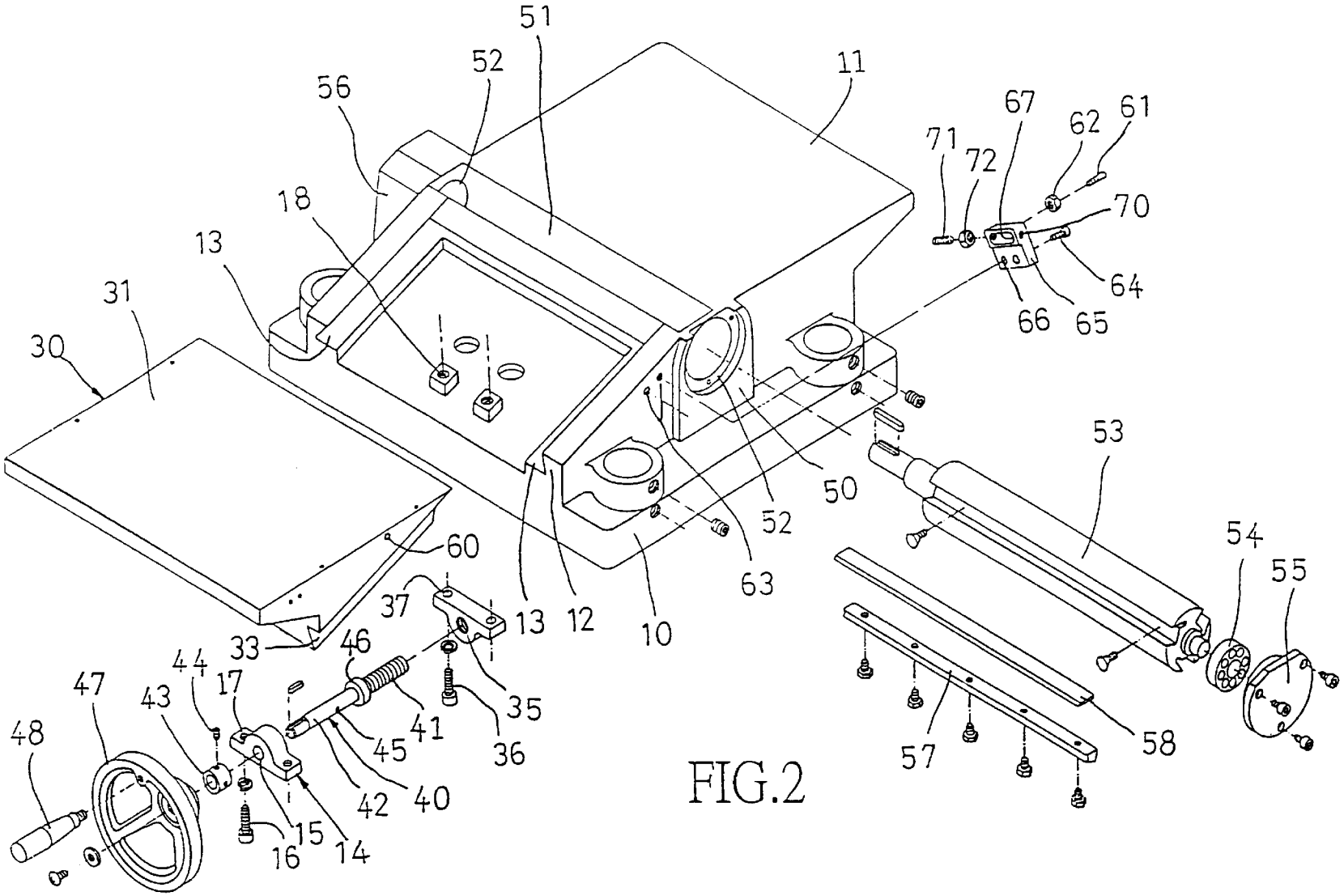
FIG. 2 is a partial exploded perspective view of the two surface planer in the present invention; and, FIG. 3 is a partial cross-sectional view of the two surface planer in the present invention, showing it being in use.

A preferred embodiment of a two surface planer in the present invention, as shown in FIGS. 1 and 2, includes mainly a lower base 10, an upper base 20 fixed on a plurality of posts 21 standing on the lower base 10, a motor 22 mounted on top of the upper base 20, a belt 23 movably disposed in an upper cutter head 24 in a bottom surface of the upper base 20, rollers 25 located at a front and a rear end of the upper cutter head 24, an elevator 26 located in the posts 21 at their lower ends for adjusting the height of the upper base 20 for adjusting the thickness of wood workpiece to be cut. This structure is a fundamental one for a single surface planer.

The key feature of the invention is additional provision of a stationary table 11 formed in a rear portion of the lower base 10, a sloped member 12 formed in a front portion of the lower base 10 and sloping up to the intermediate portion, a recessed slide way 13 shaped as a dove tail respectively at two opposite sides of the sloped member 12, and a lower bracket 14 having a center round hole 15 and two holes 17 at two sides of the round hole 15 and secured with the sloped member 12 with screws 16 passing through the two holes 17 and engaging threaded holes 18 of the sloped member 12.

Further, an adjusting base 30 is provided, having an upper horizontal surface 31 and a slide rail member 33 of a dovetail shape formed respectively at two opposite sides to fit with each slide way 13 of the sloped member 12. Further, an upper bracket 34 is provided, having a center threaded hole 35 and a hole 37 respectively at two sides of the center threaded hole 35 for screws 36 to pass though and engage with threaded holes provided in a bottom of the adjusting base 30 for fixing tightly the upper bracket 34 with the adjusting base 30.

Further, an activating rod 40 is provided, having a threaded portion 41 formed in the front portion to engage the center threaded hole 35 of the upper bracket 34, a round rod portion 42 formed in a rear portion to pass through the round hole 15 of the lower bracket 14 and further through a sleeve 43, which is fixed around the round rod portion 42 with screws 44 screwing a hole 45 in the round rod portion 42. Then the round rod portion 42 may be locked at its position by the sleeve 43 and a projecting annular edge 46 formed at an inner end of the threaded portion 41. Thus, the activating rod 40 is rotatably fixed with the sloped member 12 of the lower base 10. When a hand wheel 47 or a grip 48 fixed at the front of the activating rod 40 is rotated, the upper bracket 34 and the adjusting base 30 together are moved along on the sloped ways 13, either forward or backward slopingly with the horizontal surface 31 lifted up or lowered down at the same time.

Further, a lower cutter head 50 is provided, extending laterally in an intermediate portion between the stationary table 11 and the sloped member 12 of the lower base 10 as shown in FIG. 2, having an opening 51 laterally provided in an upper side, and a side hole 52 respectively at two opposite sides. Then a lower cutter shaft 53 is inserted in the lower cutter head 50, a bearing 54 deposited at a right side thereof, and a bearing cap 55 fixed to close up the right side hole 52. The left side of the lower cutter shaft 53 protrudes out of the left side hole 52 and is rotated by a belt arranged in belt case 56, and a motor deposited in the lower base 10 drives the belt, omitted in its minute structure as it is a well known art. The lower cutter shaft 53 has a plurality of grooves for fixing cutters 58 therein with fix plates 57 and permitting the cutters 58 protrude out of the opening 51 for a preset distance.

In using the planer in the invention, referring to FIGS. 1, if the hand wheel 47 or the grip 48 is rotated to force the upper bracket 34 and the adjusting base 30 move along the slide ways 13 and let the horizontal upper surface 31 rise up above one of the cutters 58 of the lower cutter shaft 53, the cutter 58 does not function. Then the upper cutter base 24 of the upper base operates to plane only a single upper surface of wood.

Figure 3:
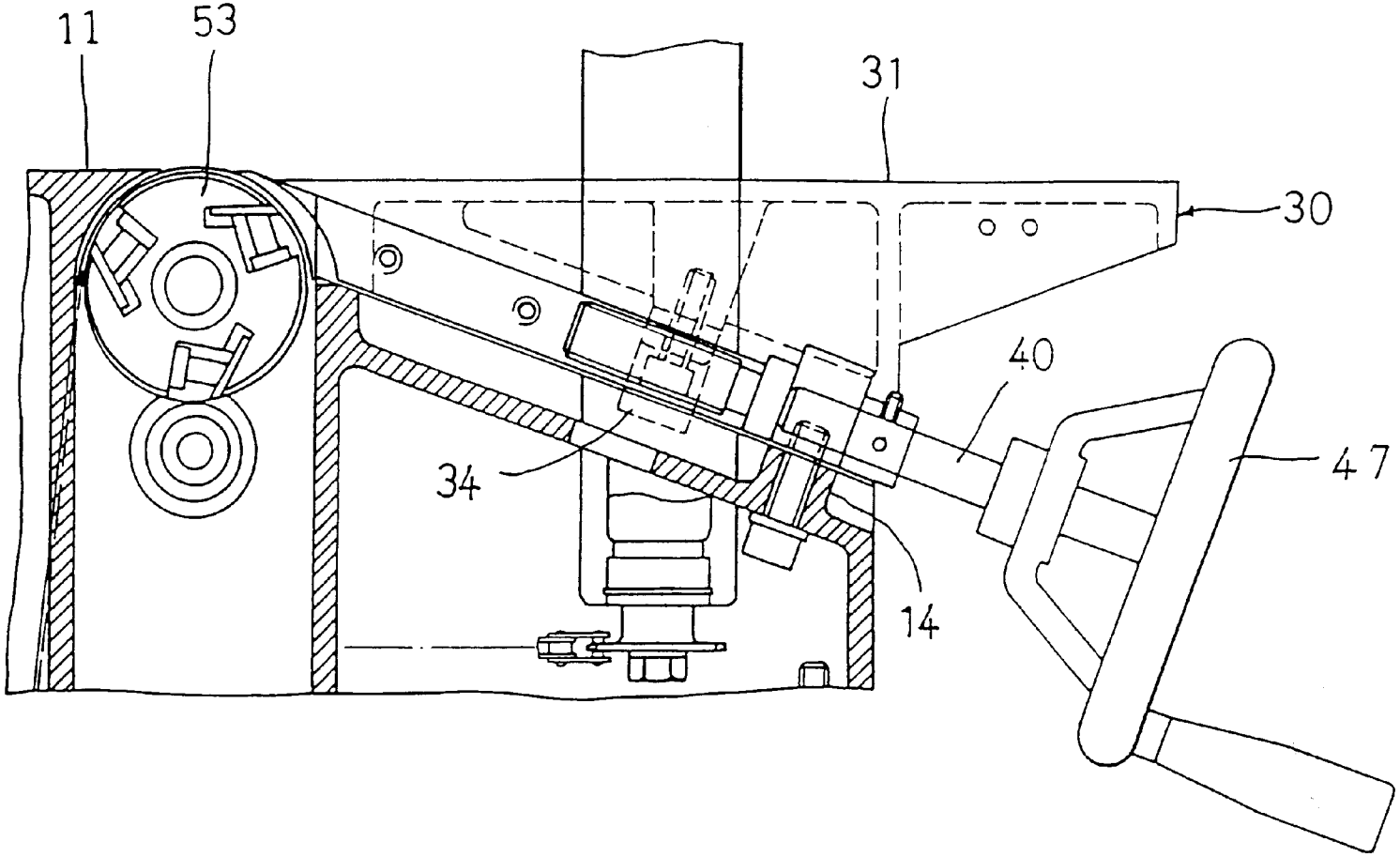

Next, as FIG. 3 shows, if the hand wheel 47 or the grip 48 is rotated, forcing the upper bracket 34 and the adjusting base 30 move back along the sloped ways 13, with the horizontal upper surface 31 moving down below the cutter 58 of the lower cutter shaft 53, the cutter 58 operates to plane a lower surface of wood synchronously with the upper cutter base 24 operating so that the two surfaces (the upper and the lower) of wood may be planed, controlled by a switch.

To control the largest distance of rising and descending of the adjusting base 30, as shown in FIG. 1, a threaded hole 60 is bored in a side wall of the adjusting base 30 for a threaded support rod 61 to engage with and secured with a nut 62. Further, two threaded holes 63 are bored in a side wall of the lower base 10 so that two screws 64 pass through two holes 66 of a position limiter 65 and then engage the two threaded holes 63 of the lower base 10, combining the position limiter 65 firmly on the lower base 10. Thus, the threaded rod 61 is movable only in the distance of a slot 67 formed in the position limiter 65, and then the adjusting base 30 may be limited in the scope of rising and descending. Further, the position limiter 65 has a threaded hole 70 respectively at two opposite sides for an adjusting bolt 71 to engage with for minutely controlling the threaded rod 61 in its moving distance, and then secured tightly with a nut 72.

So far, the relative structure and position of the main components of the two surface planer in the invention has been described. Next, action and function of the components will be described for further understanding.

The main technological feature of the invention is the sloped base 12 formed in the front portion of the lower base, sloping up gradually to the intermediate portion. Further the adjusting base 30 with the horizontal surface 31 is mounted on the sloped base 12, possible to move up and down slopingly along on the sloped member 12. And the lower cutter head 50 is located in the intermediate portion of the lower base 10, having the upper opening 51, the two side holes 52, permitting the cutter 58 of the lower cutter shaft 53 protrude up the opening 51 so that the horizontal surface 31 of the adjusting base 30 may be lifted or lowered down, enabling the cutter 58 plane wood.

The design of the up-and-down movement of the adjusting base 30 and the pivotal connection of the adjusting base 30 with the lower cutter head 50 supplies the planer in the invention with function of operating planing two surfaces of wood synchoronously, and increase its weight only a little, still possessing advantage of light weight for operating wood of small size.

While the preferred embodiment of the invention has been described above, it will be recognized and understood that various modifications may be made therein and the appended claims are intended to cover all such modifications which may fall within the spirit and scope of the invention.

What is claimed is:

1. A two surface planer comprising a lower base, an upper base fixed on a plurality of posts standing on said lower base, an upper cutter head mounted in an interior of said upper base on a bottom thereof, rollers for guiding a wood workpiece located on the bottom of the upper base, and comprising:

a stationary table formed on a rear portion of said lower base, and a sloped member formed on a front portion of said lower base and sloping gradually up to an intermediate portion thereof;

an adjusting base having a horizontal upper surface slidably mounted on the sloped member so as to slide up and down along said sloped member;

an activating rod rotatably connected with said adjusting base and said sloped member, whereby rotation of the activating rod causes said adjusting base move up and down along said sloped member;

a lower cutter head laterally mounted in the intermediate portion between said sloped member and said stationary table of said lower base, having an opening in an upper side, a side hole formed respectively in two opposite sides of the lower base for permitting a lower cutter shaft of the lower cutter head to pass through, a cutter on said lower cutter shaft protruding out of said opening for a preset distance;

a support threaded rod fitted firmly on a side of said adjusting base; and a position limiter fixed on the side of said lower base and having a slot through which the support threaded rod extends, the position limiter limiting the movement of said adjusting base to the length of said slot of the position limiter.

2. The two surface planer as claimed in claim 1, wherein said slope member has two symmetrical sloped ways at two opposite sides slidably engaging two rails provided on said adjusting base so as to enable said adjusting base to move relative to said sloped member.

3. The two surface planer as claimed in claim 1, further comprising: a lower bracket fixed on an upper portion of said sloped member, the lower bracket having a round hole in the center; an upper bracket fixed on a lower surface of said adjusting base, the upper bracket having a threaded hole in the center; a threaded portion formed on a front portion of said activating rod and threadingly engaging the threaded hole in said upper bracket, and a round rod member formed on a rear portion of the activating rod and extending through said round hole of said lower bracket, whereby, when said activating rod is rotated, said adjusting base moves up and down along on said sloped member.

4. The two surface planer as claimed in claim 1, wherein said activating rod further comprises an annular projecting edge formed in an intermediate portion and located on one side of the lower bracket; and, a sleeve fitting around said round rod member and located on a second side of the lower bracket opposite to said first side so that said activating rod may rotate in that position.

5. The two surface planer as claimed in claim 1, wherein said position limiter further comprises a threaded hole in two opposite sides, and an adjusting bolt engaging one of the threaded holes for minutely adjusting said support threaded rod.

* * * * *